US009428955B2

(12) United States Patent
Fleischman

(10) Patent No.: US 9,428,955 B2
(45) Date of Patent: Aug. 30, 2016

(54) RETRACTABLE WALL SYSTEM

(71) Applicant: Jacob Fleischman, Brooklyn, NY (US)

(72) Inventor: Jacob Fleischman, Brooklyn, NY (US)

( * ) Notice: Subject to any disclaimer, the term of this patent is extended or adjusted under 35 U.S.C. 154(b) by 516 days.

(21) Appl. No.: 13/844,611

(22) Filed: Mar. 15, 2013

(65) Prior Publication Data

US 2014/0262084 A1 Sep. 18, 2014

(51) Int. Cl.

| | |
|---|---|
| ***A47G 5/02*** | (2006.01) |
| ***E06B 9/56*** | (2006.01) |
| ***E06B 9/58*** | (2006.01) |
| ***E06B 9/40*** | (2006.01) |
| ***E06B 9/42*** | (2006.01) |
| ***E04F 10/06*** | (2006.01) |

(52) U.S. Cl.

CPC ..... *E06B 9/58* (2013.01); *E04F 10/0607* (2013.01); *E06B 9/40* (2013.01); *E06B 9/42* (2013.01)

(58) Field of Classification Search

CPC ..... E06B 9/46; E06B 9/48; E06B 9/42; E06B 9/44; E06B 9/58; E06B 9/581; E04F 10/0607

USPC ..... 160/266–273.1, 66–75

See application file for complete search history.

(56) References Cited

U.S. PATENT DOCUMENTS

| | | | | |
|---|---|---|---|---|
| 726,801 | A * | 4/1903 | Maxwell | 138/115 |
| 2,516,020 | A * | 7/1950 | Reed | 29/897 |
| 3,292,685 | A | 12/1966 | Clark | |
| 4,508,126 | A * | 4/1985 | Everard | 160/67 |
| 4,519,434 | A * | 5/1985 | Forquer | 160/133 |
| 4,720,647 | A | 1/1988 | Plumer | |
| 5,220,721 | A | 6/1993 | Thierry | |
| 5,323,831 | A | 6/1994 | Manthei | |
| 5,374,791 | A | 12/1994 | LeMarchand | |
| 5,429,558 | A | 7/1995 | Lagarde | |
| 6,006,811 | A | 12/1999 | Brutsaert | |
| 2006/0118356 | A1 | 6/2006 | Beeson et al. | |
| 2008/0016798 | A1* | 1/2008 | Miller | E06B 9/581 52/202 |
| 2011/0088317 | A1 | 4/2011 | Goldberg | |
| 2011/0100570 | A1* | 5/2011 | Licciardi Di Stefano | 160/368.1 |
| 2013/0048229 | A1 | 2/2013 | Dwarka | |
| 2014/0041814 | A1 | 2/2014 | Roberts | |
| 2015/0000849 | A1* | 1/2015 | Barnes et al. | 160/310 |

FOREIGN PATENT DOCUMENTS

| | | |
|---|---|---|
| EP | 0841442 B2 | 8/2000 |
| EP | 2343418 A1 | 7/2011 |
| EP | 2392747 A2 | 12/2011 |
| EP | 2489811 A1 | 8/2012 |

OTHER PUBLICATIONS

Super Soundproofing Co, Acoustical Soundproofing Curtains, Drapes, Clear sheeting and Strip Doors; published Feb. 10, 2013; accessed Nov. 3, 2015.*

(Continued)

*Primary Examiner* — Syed A Islam
*Assistant Examiner* — Jeremy Ramsey
(74) *Attorney, Agent, or Firm* — Law Office of Arthur M. Antonelli, PLLC

(57) ABSTRACT

The present invention is directed to an apparatus for erecting a retractable wall system. More particularly, this invention relates to a retractable wall system and its components which may be used to divide a room or space, create an acoustic barrier, create a freestanding structure, or provide an awning.

20 Claims, 16 Drawing Sheets

(56) References Cited

OTHER PUBLICATIONS

International Search Report, PCT/US2014/030073, Jacob Fleischman, pp. 1-2. Aug. 11, 2014.
Written Opinion of the International Searching Authority, PCT/US2014/030073, Jacob Fleischman, pp. 5, Aug. 11, 2014.
AHT-Field Measure-Roll-Down, Advanced Hurricane Technology, undated.
FlexShadeXDFact Sheet, Draper Inc., Spiceland, IN, 2011.
RS-30 Motorized System Exploded View, BTX Window Automation, Dallas, TX, p. 1, Apr. 11, 2006.
RS-10 Fascia System Exploded View, BTX Window Automation, Dallas TX, p. 1, Mar. 28, 2000.
Section 7, Motors & Accessories, Somfy Motors, Pearland, TX, pp. 11, undated.
Somfy Motor Catalog, Somfy Systems, Inc., pp. 78, Dec. 2003.
International Search Report, PCT/US2015/031258, Jacob Fleischman, pp. 1-2, Sep. 16, 2015.
"Model Reinforced Barrier B-10R" Sound Seal—Industrial Noise Control Products. <<http://www.soundseal.com/barricade/reinforced-barrier-b10r.shtml>.
"Sound Absorbtion" Accoustical Surfaces, Inc. <<http://www.acousticalsurfaces.com/acoustic_IOI/101_7.htm>.

* cited by examiner

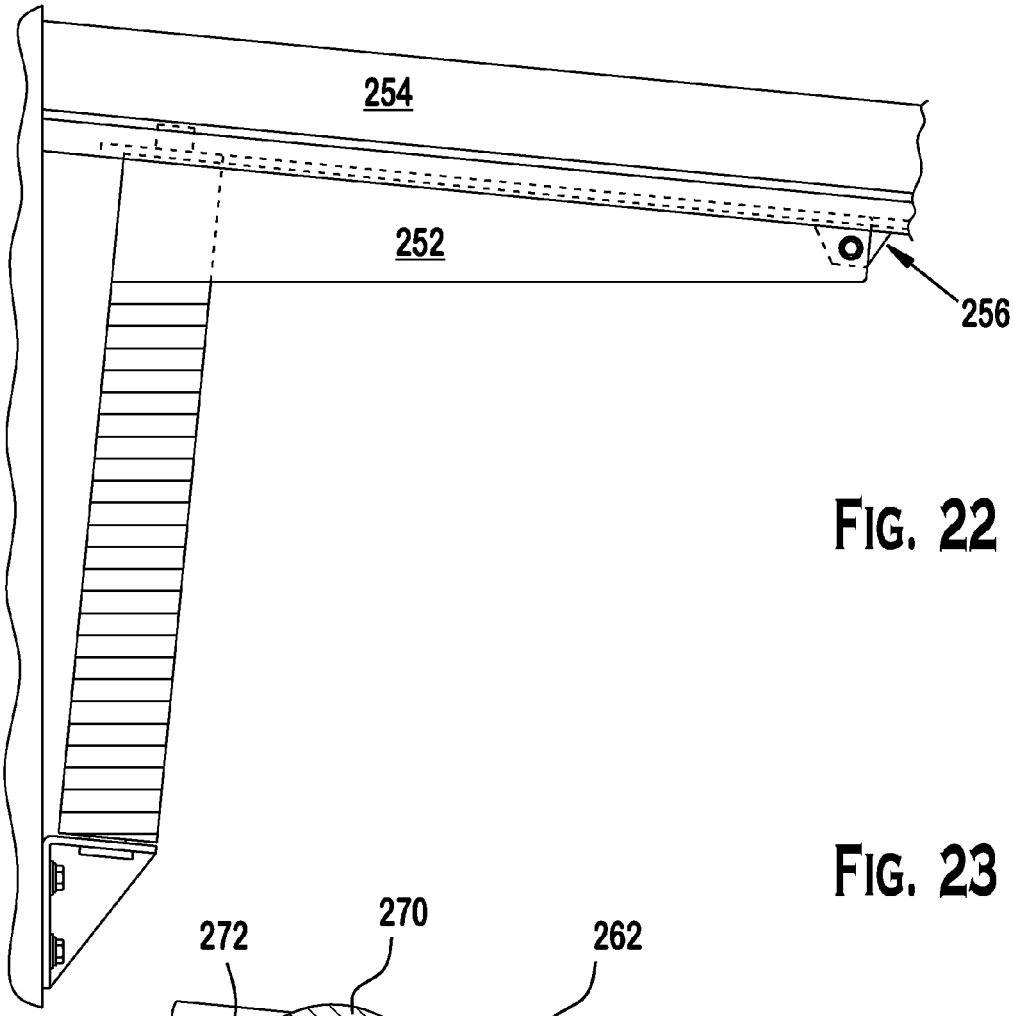
FIG. 22
FIG. 23
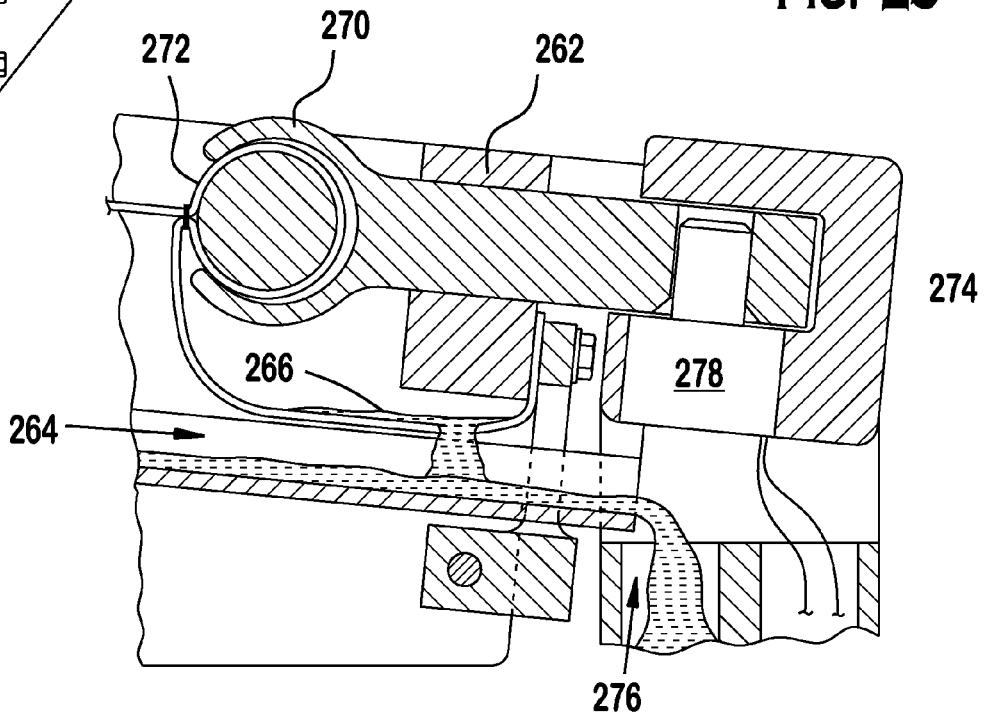

RETRACTABLE WALL SYSTEM

FIELD OF THE INVENTION

The present invention generally relates to apparatus for erecting a retractable wall system. More particularly, this invention relates to a retractable wall system and its components which may be used to divide a room or space, create an acoustic barrier, create a freestanding structure, or provide an awning.

BACKGROUND

Roller shades may be useful for blocking out light and enhancing privacy for windows. Retractable walls may provide the ability to divide a room or provide shade for exterior porches. Still, a need exits for improved retractable wall systems that may span longer distances and utilize heavier fabrics.

SUMMARY

Hence, the present invention is directed to a track for a retractable wall system which includes an elongated member having a first cross-sectional profile. The first cross-sectional profile may include a front wall, a rear wall spaced from the front wall, and a bottom wall connecting the front wall and the back wall. The first cross-sectional profile may include a first top wall adjacent the front wall, a second top wall adjacent the rear wall, and an open channel disposed between the first top wall and the second top wall. The open channel may include a first side wall connected to the first top wall, a second side wall connected to the second top wall, a first ledge extending from the first side wall into the open channel, and a second ledge extending from the second side wall into the open channel. The first and second ledges may define a slot between the first side wall and the second side wall. The first cross-sectional profile further may include a conduit disposed between the front wall and the rear wall which is connected to the open channel via the slot.

In another aspect of the invention, the first cross-sectional profile further may include a lateral wall that extends from the front wall to the back wall. The conduit may be formed by the first ledge, the second ledge, the first side wall, the second side wall, and the lateral wall. The lateral wall may be connected to the first side wall and the second side wall.

In another aspect of the invention, the first cross-sectional profile may include an interior wall that extends from the front wall to the back wall. The front wall, lateral wall, rear wall and interior wall may define a first interior channel. The front wall, interior wall, rear wall and bottom wall may define a second interior channel. The front wall, the first top wall, the first side wall and the lateral wall may define a third interior channel. And, the rear wall, the second top wall, the second side wall and the lateral wall may define a fourth interior channel.

In another aspect of the invention relates to a retractable wall system which may include a tube having with a longitudinal axis, a first track disposed perpendicular to the longitudinal axis, a second track spaced from the first track, and a third track. The third track may include a first traveling guide disposed in the open channel of the first track and a second traveling guide disposed in the open channel of the second track. The retractable wall system further may include a flexible membrane barrier sheet connected to the tube. The sheet may include first, second and third zippered sides. The first zippered side may be disposed in the conduit of the first track and secured to the first traveling guide. The second zippered side may be disposed in the conduit of the second track and secured to the second traveling guide. The third zippered side may be disposed in the conduit of the third track.

In another aspect of the invention, the tube may be a thin wall hollow member. The tube may have a cross-sectional profile that comprises a substantially circular outer wall. The cross-sectional profile further may include a plurality of interior structural members. The plurality of interior structural members may each define a chord within the tube.

In another aspect of the invention, each interior structural member may connect to an adjacent structural member to form an external node which is located about the circumference of the tube. Each interior structural member further may connect to a second adjacent structural member to form another external node that is located about the circumference of the tube. The intersection of two structural members at an external node may form a right angle.

In another aspect of the invention, each interior structural member may intersect another interior structural member to form an internal node. The intersection of two interior structural members at an internal node may form an obtuse angle, which may measure approximately 135 degrees.

DESCRIPTION OF THE DRAWINGS

The accompanying drawings, which are incorporated herein and constitute part of this specification, illustrate an embodiment of the invention, and together with the general description given above and the detailed description given below, serve to explain the features of the invention.

FIG. 22 is a side view of the retractable awning system of FIG. 20;

FIG. 23 is a sectional view of the front partition of the retractable awning system of FIG. 20;

DESCRIPTION

Figure 1:
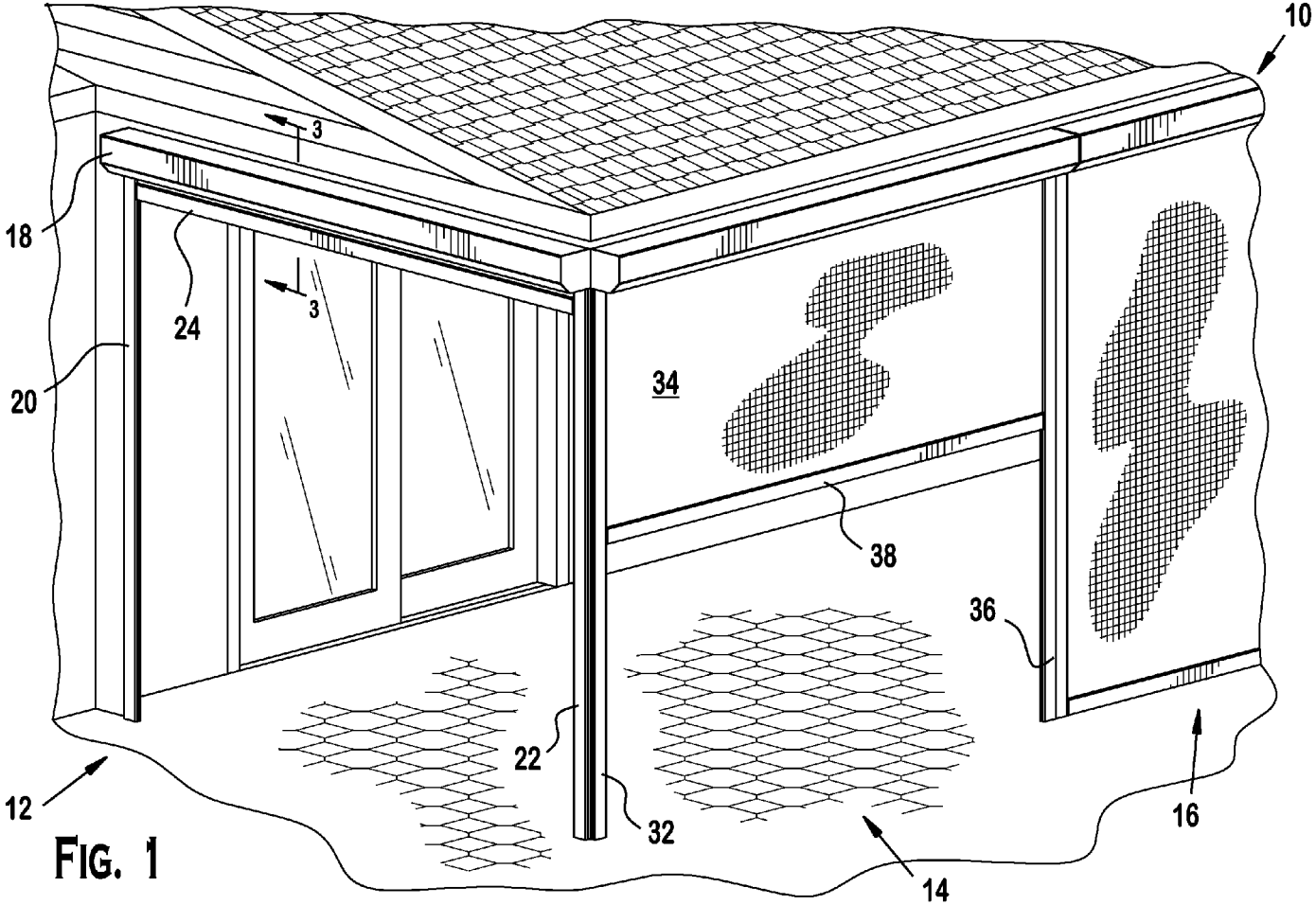
FIG. 1 is a perspective view of a covered patio enclosed on two sides by an embodiment of the retractable wall system of the present invention.

FIG. 1 is a perspective view of a patio enclosure 10 formed by three retractable wall systems 12, 14, 16. The first retractable wall system 12 may be disposed perpendicular to the house and may extend from the side of the house to a first corner of the patio. The second retractable wall system 14 may be disposed perpendicular to the first retractable wall system 12 and may be parallel to the sliding door of the house. The third retractable wall system 16 may be next to the second retractable wall system 14. The first retractable wall system 12 may be disposed in an opening under the roof structure of the house. The first retractable wall system 12 may include a head rail 18, a left side track 20, right side track 22, and a horizontal track 24 disposed between the left side track 20 and the right side track 22. In a preferred embodiment, the left side track 20, the right side track 22 and the horizontal track 24 have the same cross-sectional profile.

Figure 2:
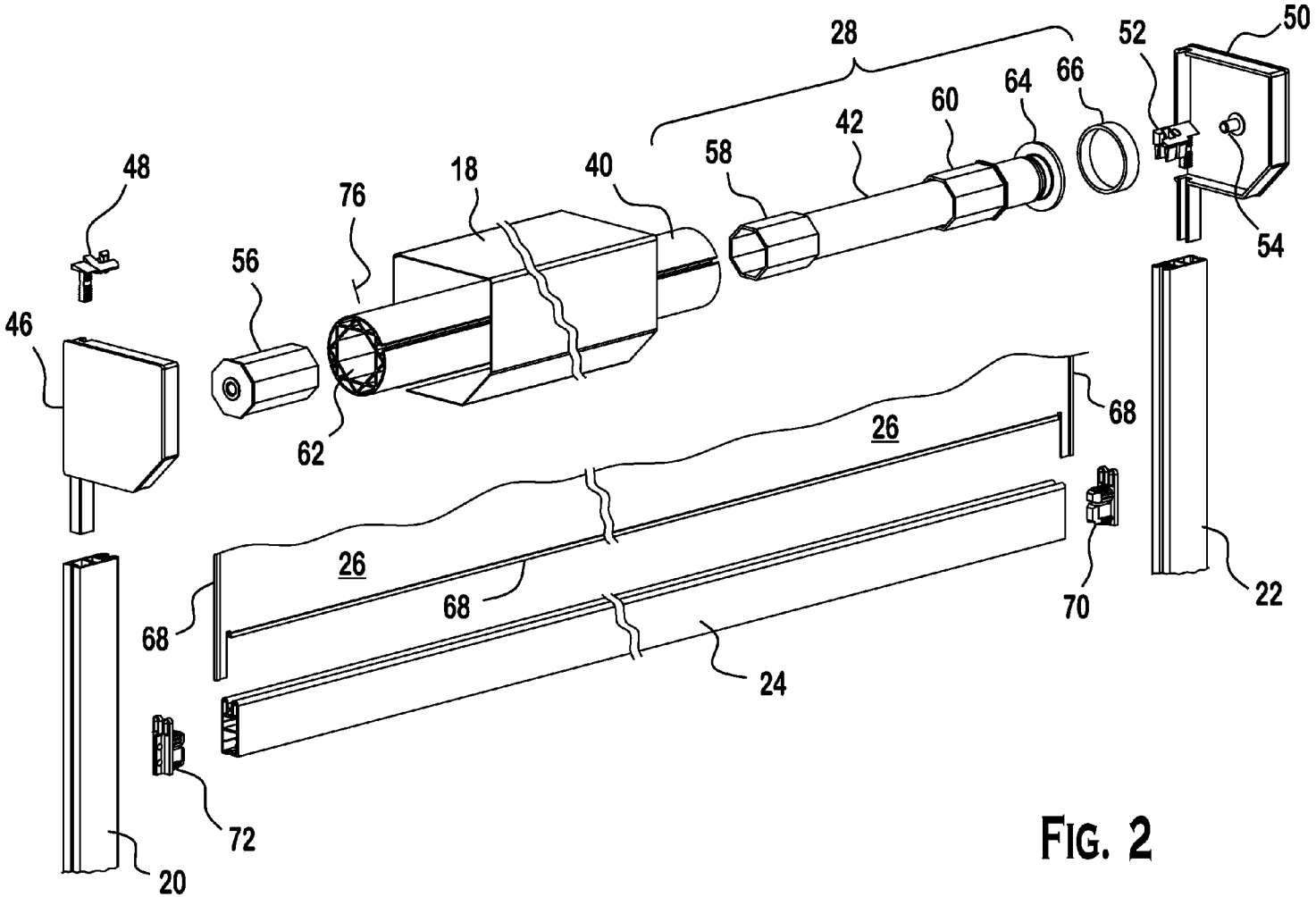
FIG. 2 is an exploded view of an exemplary embodiment of the retractable wall system of the present invention.
Figure 3:
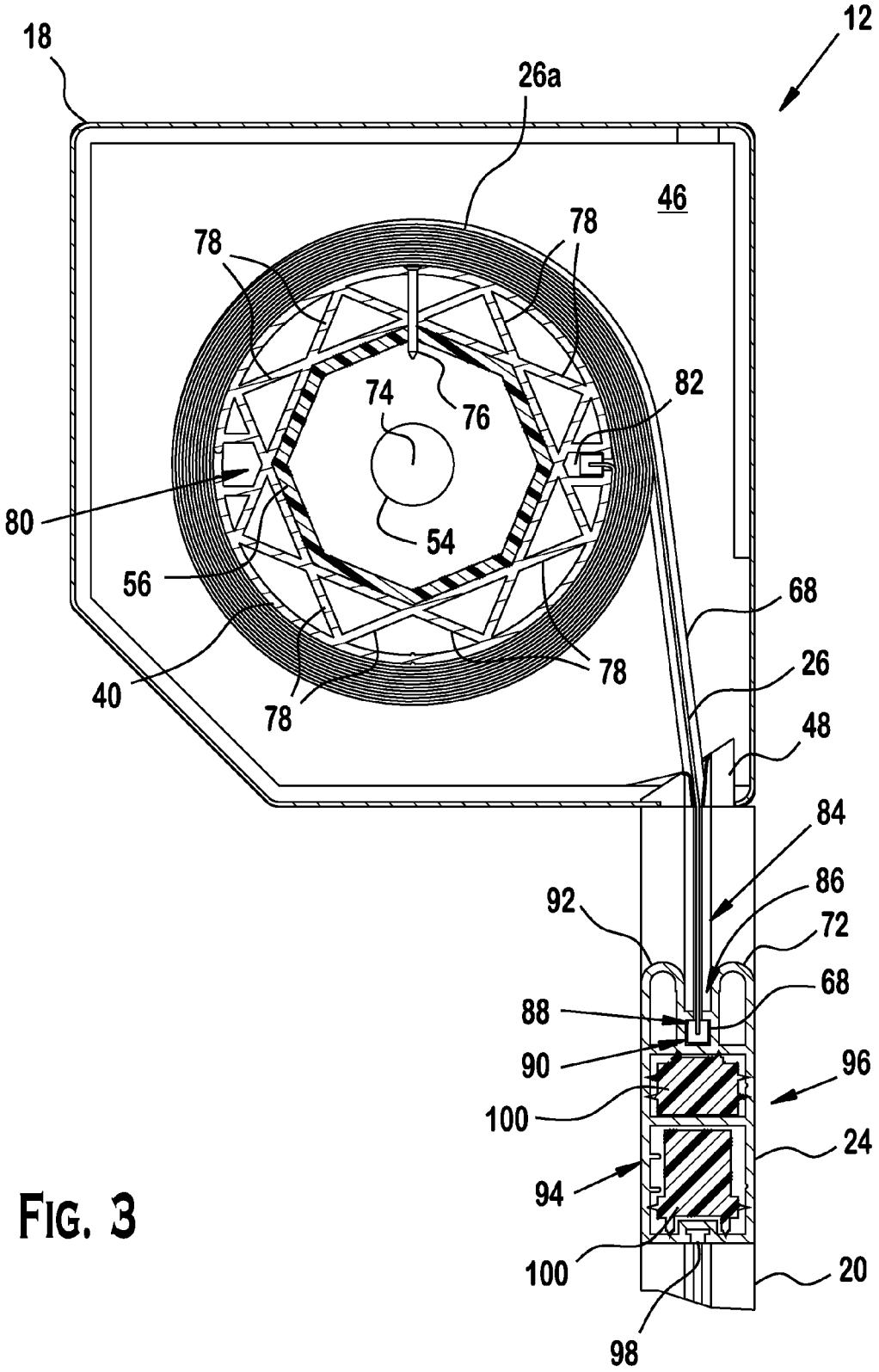
FIG. 3 is a partial sectional view of the first retractable wall system along line 3-3 of FIG. 1.

In FIG. 1, the first retractable wall system 12 is in a raised configuration. In the raised configuration the horizontal track 24 abuts the head rail 18. Referring to FIG. 3, the head rail 18 may contain a roll of flexible barrier material 26*a*, as well as a mechanism (not shown) 28 for raising and lowering the flexible barrier membrane 26. As shown in FIG. 2, the mechanism 28 may include an electrical motor 42, which may be controlled by a wireless remote or switch. Alternatively, the mechanism may include a hand crank or a chain drive with a looped strap for manually raising and lowering the flexible barrier membrane.

Referring to FIG. 1, the left side track 20 of the first retractable wall system 12 may be secured to the building. By contrast, the right side track 22 of the first retractable wall system 12 may be connected to the left side track 32 of the second retractable wall system 14 at a 90 degree angle to form a corner assembly. The second retractable wall system 12 is shown in a partially lowered configuration. A flexible barrier material 34 may be disposed between the left side track 32, right side track 36 and horizontal track 38 of the second retractable wall system 14. The flexible barrier material 34 may extend from inside each of these three tracks 32, 36, 38 to create a wall.

As shown in FIG. 3, the flexible barrier material 26 may be disposed on a tube 40 in the head rail. The flexible barrier material 26 may be rolled onto the tube 40 and unwound from the tube as the horizontal track 24 is lowered. Referring to FIG. 1, the third retractable wall system 16 may be disposed parallel to the second retractable wall system 14. The right side track of the second retractable wall system 14 and the left side track of the third retractable wall system 16 may be secured together or connected to a secondary structural member (e.g., a post or stud). The third retractable wall system 16 is shown in the lowered configuration.

FIG. 2 shows an exploded view of the first retractable wall system 12. The retractable wall system 12 may include a left side track 20, a right side track 22, and a horizontal track (or weight bar) 24 extending between the left side track and the right side track. Additionally, the retractable wall system 12 may include a left side end-cap 46 which is secured into the left side track 20 and a left side feeder-clip 48 that is positioned in the left side end-cap 46. Similarly, the retractable wall system 12 includes a right side end-cap which may be secured into the right side track 22, as well as a right side feeder-clip 52 that may be disposed in the right side end-cap 50. When the left side end-cap 46 is fully seated in the left side track 20 the left side feeder-clip 48 interlocks with features of the left side track 20 cross sectional profile to further secure the left end-cap to the left side track. Similarly, when the right side end-cap 50 is fully seated in the right side track 22, the right side feeder-clip 52 interlocks with features of the right side track 22 cross-sectional profile to further secure the right end-cap to the right side track. Each end-cap 46, 50 further may include a cylindrical stub 54 in the end-cap wall. The cylindrical stub 54 may receive the tube assembly and serve as axis of rotation for the tube 40.

The roller tube assembly may include an idler 56, a tube 40 having a central axis, and a mechanism 28 for rotating the tube 40 about the central axis of the tube. In a preferred embodiment, the mechanism 28 may include a motor 42 that is partially installed with the tube 40. The motor 42 may include a built in radio control receiver that provides a user the capability to operate the motor with a remote control. For example, the motor may be a Somfy RTS motor.

In FIG. 2, the mechanism 28 for rotating the tube includes a motor 42 with a remote control. The motor, which may be slidably received within the tube 40, may include a drive 58 and a crown 60. The drive 58 and crown 60 may be external features of the motor which interlock with an interior surface 62 of the tube so as to provide a mechanism for transferring rotational movement from the motor or the tube. The motor 42 further may include a drive wheel 64 at one end. The drive wheel 64 may be configured and dimensioned to be fixedly received within a motor bracket 66. The motor bracket 66 may be secured to one end-cap 50. The tube assembly 28 further may include a sheet of flexible material 26. The sheet of flexible material 26 may include a zipper border 68 on at least three sides. The sheet of flexible material 26 may be cut to be received in a pair of traveling guide pieces 70, 72 that are adapted to be received in the horizontal track 24.

FIG. 3 shows a cross-section of the retractable wall system 12 taken perpendicular to the central axis 74 of the tube 40. The tube 40 may be mounted on the cylindrical stub 54 of the left end-cap 46. The tube 40 may be secured to the idler 54 with a fastener. Inside the tube 40 are interior wall segments 78, which form a mating structure for the motor drive and crown. The interior wall segments 78 may be arranged to provide structural rigidity to the tube. In particular, the interior wall segments may span the internal space of the tube 40 so as to provide a three dimensional truss or space frame. Additionally, the tube may include a fabric pocket receiving channel 80 and a fabric zipper receiving channel 82, which may be used to connect the flexible barrier material 26 to the tube 40. Wrapped around the tube 40 is a sheet of flexible barrier material 26*a*, which may include a heat bonded zipper edge 68 on the left side and the bottom side of the sheet.

The end-cap 46 may be situated within the left side track 20. The left side of the flexible barrier material sheet 26 may be fed through the left side feeder-clip 48 into a rigid receiving channel 84*a* in the left side track 20. The bottom side of the flexible barrier material 26 sheet may be received within the horizontal track 24. The cross-sectional profile of the left side track 20 and horizontal track 24 may be the same. Accordingly, the flexible barrier material 26 may be secured to the horizontal track 24 through a rigid receiving channel 86 in the horizontal track 24. A slot 88 may connect the rigid receiving channel 88 to an internal anchoring cavity 90 that is configured and dimensioned to receive the bonded zipper edge 68 of the sheet. The rigid receiving channel 86 may be disposed between a pair of arcuate walls 92. The internal anchoring cavity 90 may be disposed adjacent to the rigid receiving channel 86.

The horizontal track 24 further may include a primary accessory receiving channel 94, a secondary accessory receiving channel 96, and a tertiary accessory receiving channel 98. Weights, for example, steel bars 100 may be placed with the primary accessory receiving channel 94 or the secondary accessory receiving channel 96 of the horizontal track 24 to facilitate lowering of the flexible material barrier 26. In another example, sound dampening material may be inserted in these spaces to increase the sound insulating properties of the retractable wall system. An elastomeric end cap, flexible seal, or brush may be inserted in the tertiary accessory receiving channel 98 to provide an improved connection with the ground surface for purposes such as, without limitation, increasing wall stability, slip resistance, draft prevention, or sound dampening.

Figure 4:
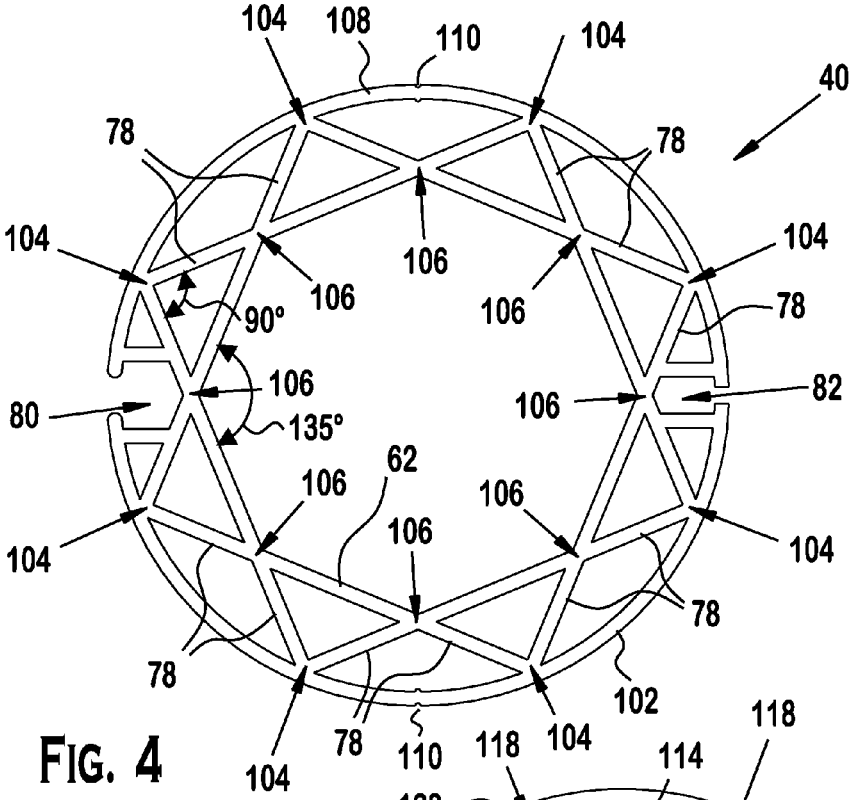
FIG. 4 is a sectional view of the tube of FIG. 3.

FIG. 4 shows a cross section of a preferred embodiment of the tube 40. Generally, the tube 40 may be a thin-wall hollow member. The outer surface 102 of the tube may be substantially circular, and the interior space of the tube may include a series of interior wall segments (or structural members) 78, which may reinforce the tube against bending moments that may be generated from the weight of flexible barrier material on the tube when the tube is positioned between the end caps. Each structural member 78 may form a cord within the tube 40. Each structural member 78 may connect to an adjacent structural member 78 to form an external node 104, which is located about the circumference of the tube. Additionally, each structural member 78 may intersect two other structural members 78 to form a pair of internal nodes 106. The intersection of a pair of structural members 78 at an external node 104 forms a right angle. The intersection of a pair of structural members 78 at an internal node forms an obtuse angle of approximately 135 degrees. The space between an internal node 106 and outer wall 108 of the tube may be used to house the pocket receiving channel 80 and the zipper receiving channel 82. Additionally, a fastener alignment groove 110 may be disposed above one or more internal nodes on the outer surface 102 of the tube. The interior surface 62 of the tube may form an eight sided shape for receiving a motor (with a mating drive and crown) or an octangonal tube for non-motorized applications (e.g., 40 mm, 60 mm, or 80 mm tubes).

Figure 5:
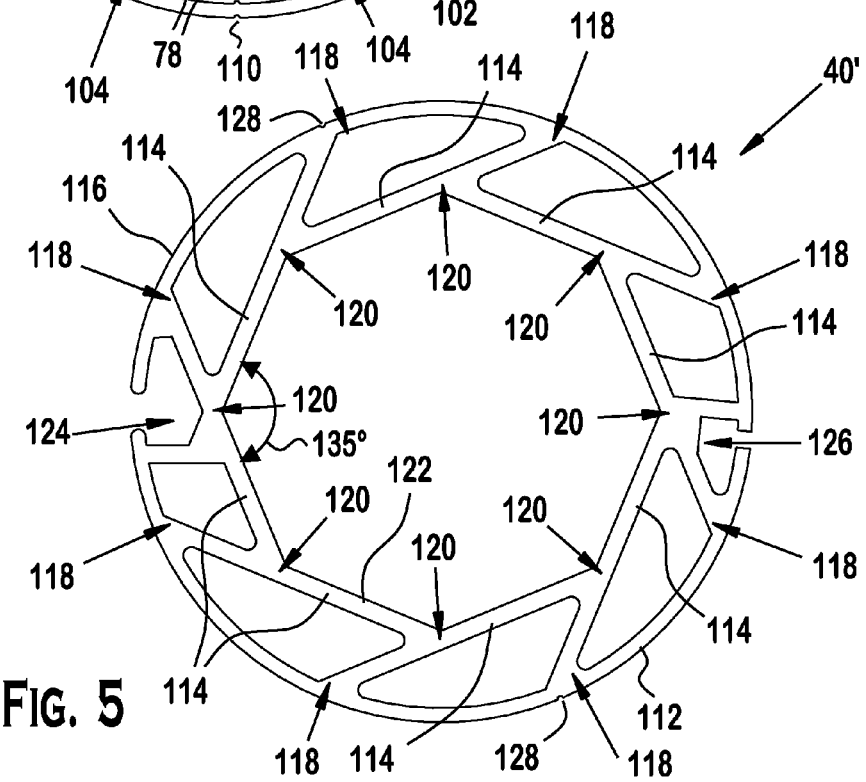
FIG. 5 is a sectional view of another embodiment of the tube of FIG. 3.

FIG. 5 shows the cross-section of another embodiment of the tube 40'. In this embodiment, the outer surface 112 of the tube 40' is substantially circular and the interior space includes a series of structural members 114 that reinforce the tube 40' from bending moments as in the previous embodiment. In contrast to the tube of FIG. 4, however, each structural member 114 connects to the outer wall 116 of the tube at one location (or external node) 118. Additionally, the opposite end of each structural member 114 may connect to an adjacent structural member 114 to form an internal node 120. The interior surface 122 of the tube 40' may form an eight sided shape for receiving a motor (with a mating drive and crown) or an octangonal tube for non-motorized applications (e.g., 40 mm, 60 mm, or 80 mm tubes). In this embodiment, the tube 40' also may include a pocket receiving channel 124, a zipper receiving channel 126, and two fastener alignment grooves 128.

Referring to FIGS. 4 and 5, the tube 40, 40' may have an outer diameter of approximately 1.0 inches to approximately 6.0 inches, but other dimensions may be used where appropriate for the application. In an exemplary embodiment, the tube 40, 40' may have an outer diameter of approximately 3.5 inches and an interior surface 62, 122 which is configured and dimensioned to receive a 60 mm octagonal tube. Additionally, the tubes 40, 40' may range from approximately one foot long to approximately 30 feet in length. The tube 40, 40' may be formed from aluminum or an aluminum alloy (e.g., 6061 aluminum alloy (International Alloy Designation System)), however, other suitable metals, alloys or materials may be used to form the tube provided the material has sufficient strength. For example, the tube 40, 40' may be formed from a carbon graphite reinforced polymer material. Preferably, the tube 40, 40' may be formed by materials having a high strength to weight ratio and the ability to be manufactured using extrusion technologies.

Referring to FIG. 4, the flexible barrier material 26 may be secured to the tube 40 by a pocket of flexible barrier material 130 and rod 132 inserted within the pocket receiving channel 80. In another alternative, the flexible barrier material 26 may be attached to a zipper 68 that is inserted into the zipper receiving channel 82. Generally, the flexible barrier material 26 may range from approximately 1/32 of an inch in thickness to approximately ½ inch in thickness. The flexible barrier material 26 may be formed, without limitation, from natural fibers, leather, PVC, polyester, or acrylic materials. Preferably, the flexible barrier material 26 may range from approximately 7 ounces to 60 ounces in weight. In one example, the flexible barrier material 26 may be constructed from a 20 ounce vinyl fabric. In another example, the flexible barrier material 26 may be constructed from a vinyl fabric that is capable of receiving a print design. In another example, the flexible barrier material 26 may be constructed from a screen, a transparent material or a natural fabric.

The flexible barrier material 26 may be a single layer of material or a multilayer material formed from two or more layers of material. For example, the flexible barrier material 26 may be formed from three layers: a middle layer having enhanced sound dampening properties (e.g., mass loaded vinyl, Acoustiblok®) and two outer fabric layers (e.g., cotton, polyester, rayon, vinyl, wall paper, or wall covering material) to create an acoustic barrier. In another example, the flexible barrier material 26 may be formed from clear plastic sound blocking material. Preferably, a flexible barrier material with enhanced sound dampening properties may have a STC (Sound Transmission Class) Rating of 26 or greater.

Figure 6:
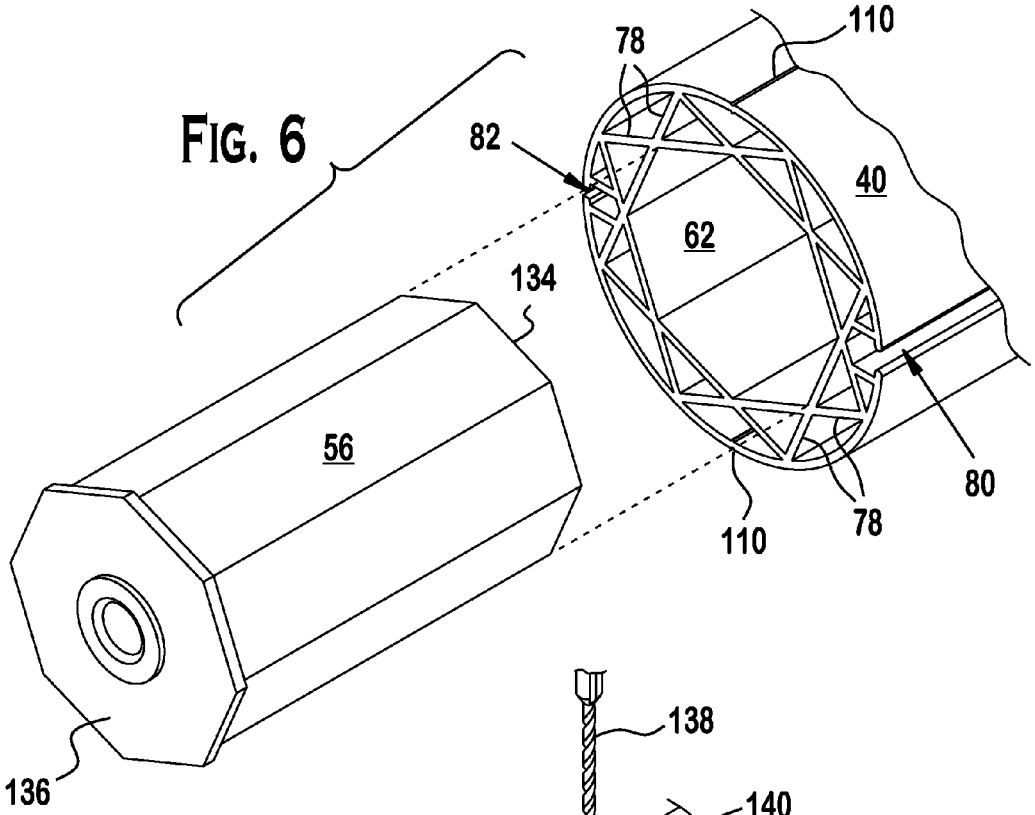
FIG. 6 is a perspective view of an exploded view of an idler and tube of FIG. 3.
Figure 7:
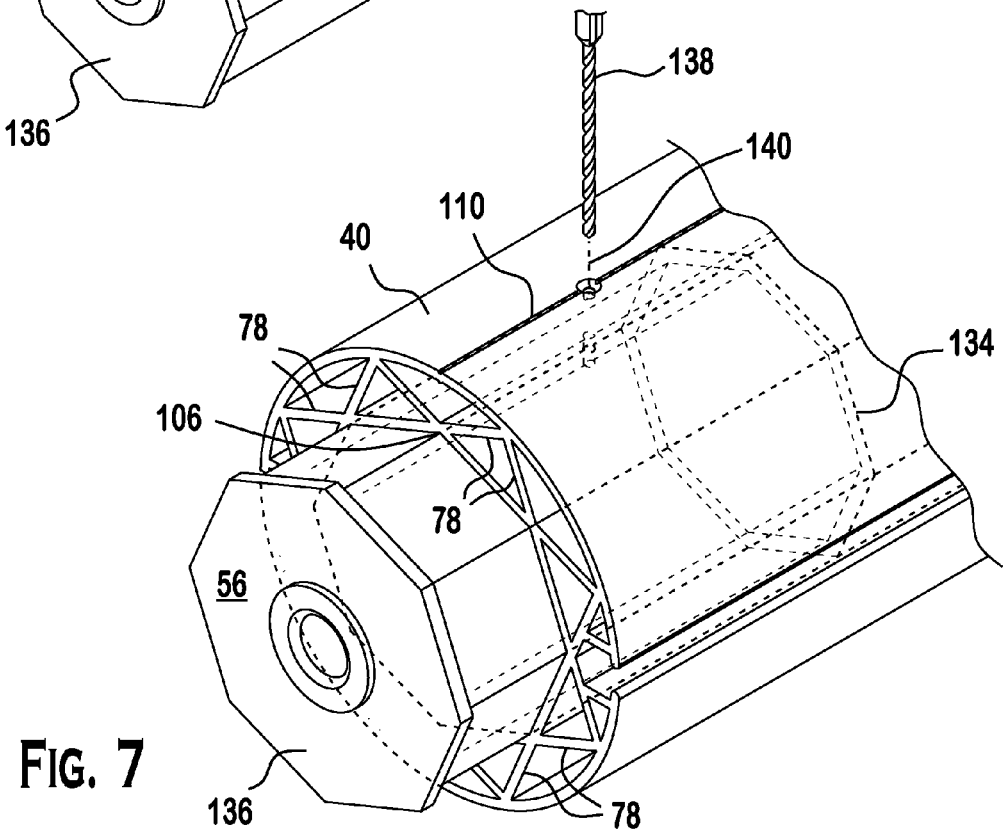
FIG. 7 is a perspective view of the idler and tube of FIG. 6 being assembled.

FIG. 6 shows an exploded view of the idler 56 and the tube 40 of FIG. 4. One end 134 of the idler 56 may be inserted into the tube 40. The opposite end 136 of the idler 56 may be mounted on the end-cap cylindrical stub 54 (not shown) to form an axis of rotation. The tube 40 may include one or more fastener alignment grooves 110. As shown in FIG. 7, a drill (or fastener) 138 may be placed in a fastener alignment groove 110 to create a fastener alignment path 140 for securing the idler 56 to the tube 40. The fastener alignment groove 110 may be located above an internal node 106 of the tube. Placement of a fastener alignment groove 110 above an internal node 106 provides a mechanism for promoting a repeatable, quick, and straightforward method of securing the idler 56 and the tube 40 with a fastener 138. More particularly, the fastener path 140 connects the fastener alignment groove 110 and the internal node 106 of the tube. A fastener that is aligned in this manner may be expected to penetrate the tube 40 beneath the fastener alignment groove 110 and be guided by adjacent internal structural members 78 to a position above the internal node 106. This fastener path may provide a secure connection because the fastener may be driven perpendicular to the outer surface of tube wall and through the internal node 106 before advancing into and securing the idler 56.

Figure 8:
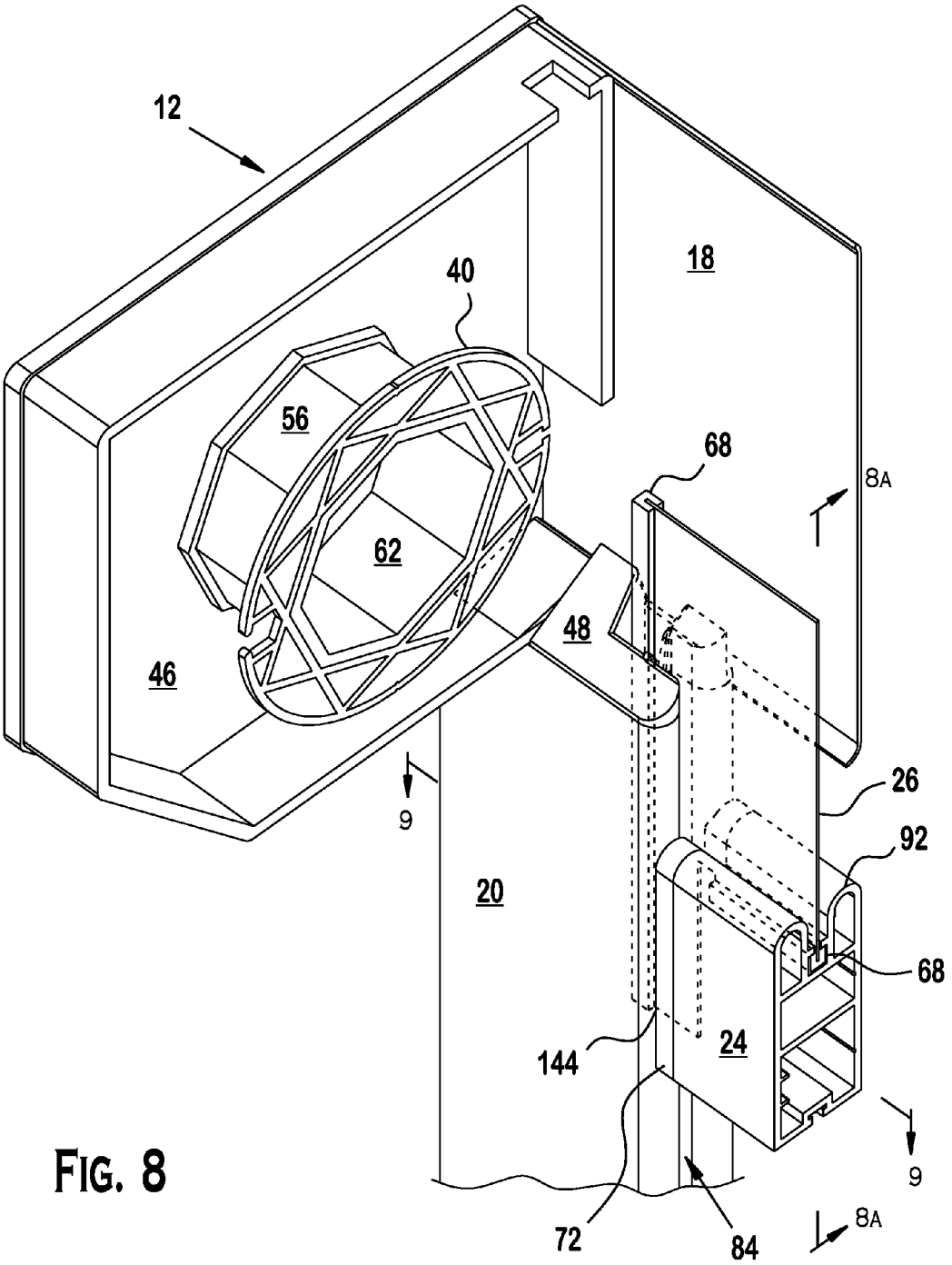
FIG. 8 is a partial sectional view of the tube, horizontal track, and flexible barrier of FIG. 1.
Figure 8A:
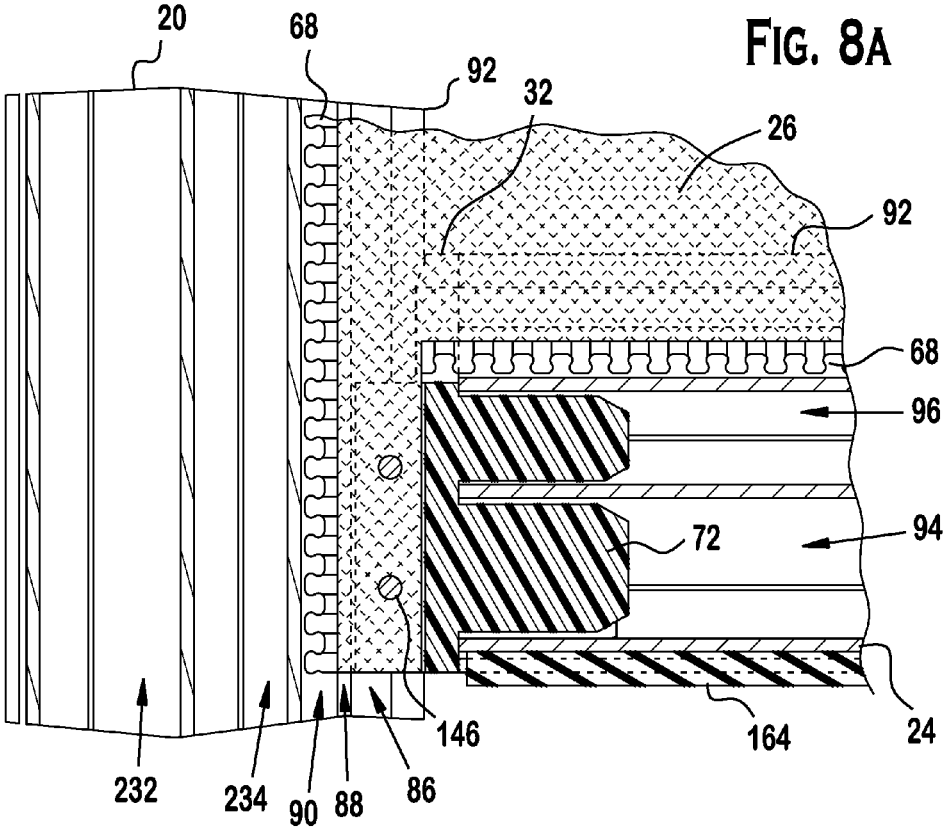
FIG. 8*a* is a partial sectional view of FIG. 8.

FIG. 8 shows the left side of the flexible barrier member 26 disposed in the left side feeder-clip 48 and left side track 20 of the retractable wall system 12. Also, the bottom of the flexible membrane barrier 26 is shown locked into the horizontal track 24. As shown in FIG. 8A, the left side of the flexible material barrier is fully seated within the traveling guide pin 72. The full length square cut double pin construction 142 provides rigid reinforcement of the flexible barrier material 26 at a leading edge 144 of the sheet. As the leading edge of the sheet 144 may be subject to compressive and sheering forces as the barrier is lowered, the traveling guide pin 72 may prevent the flexible barrier material 26 from wearing, tearing, bunching or binding in the vertical track 20 when the horizontal track 24 is lowered or raised.

Figure 9:
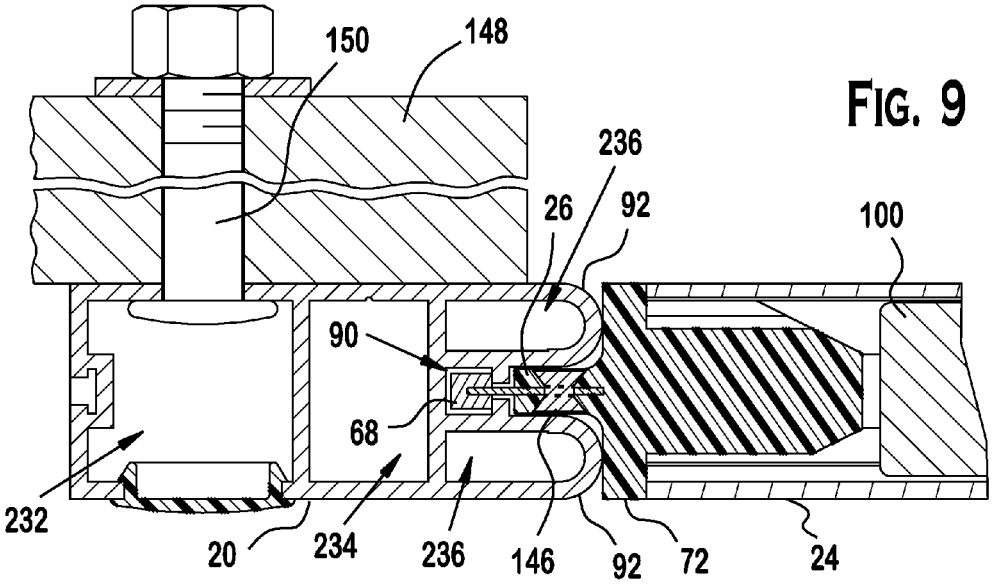
FIG. 9 is a partial cross-sectional view of the left side track and horizontal track of FIG. 1, taken perpendicular to the longitudinal axis of the left side track.

Moreover, as shown in FIG. 9, the traveling guide pin 72 may be configured and dimensioned to be slidably received within the rigid receiving channel 84 of the vertical track 20. As the fasteners, which secure the flexible membrane barrier 26 to the traveling guide pin 72 are located with the rigid receiving channel 84, they may be recessed or flush with the exterior surfaces of the traveling guide pin 72. The zipper portion 68 of the flexible membrane barrier 26, when disposed in the internal anchoring cavity 90, pulls the traveling guide pin 72 into the rigid receiving channel 84 of the vertical track 20. In this manner, the horizontal track 24 and the sides of the flexible membrane barrier 26 may be securely positioned within the left side track 20 and the right side track 22.

The reinforcement of the flexible barrier material 26 and tension across the vertical tracks 20, 22 may increase the structural integrity of retractable wall system 12, provide for more reliable operation of the system, and reduce mechanical fatigue of the zipper-material interface. Also, the generally uniform tension across the flexible membrane barrier 26 may increase the aesthetic appeal of the retractable wall system 12 by enhancing a uniform appearance of the flexible barrier material across the structure. Moreover, in outdoor applications, this construction may prevent drafts. In sound barrier applications, this construction may promote the deployment of a continuous sound dampening barrier and prevent fugitive sound emissions from passing individual barrier elements to reduce the effective sound dampening properties of the retractable wall system. Sound dampening material may be placed in the primary accessory receiving channel 232, the secondary receiving channel 234, and the arcuate receiving channels 236 as well.

The vertical track 20 of the retractable wall system may be secured to a structural member such as a stud or post. A pilot hole may be drilled and then a larger access hole placed in the track 20 to allow a fastener 150 to be advanced though the opposite side the track and into external structural framing 148 to securely attach the vertical track 20 to structural framing of an adjacent wall or post.

Figure 10:
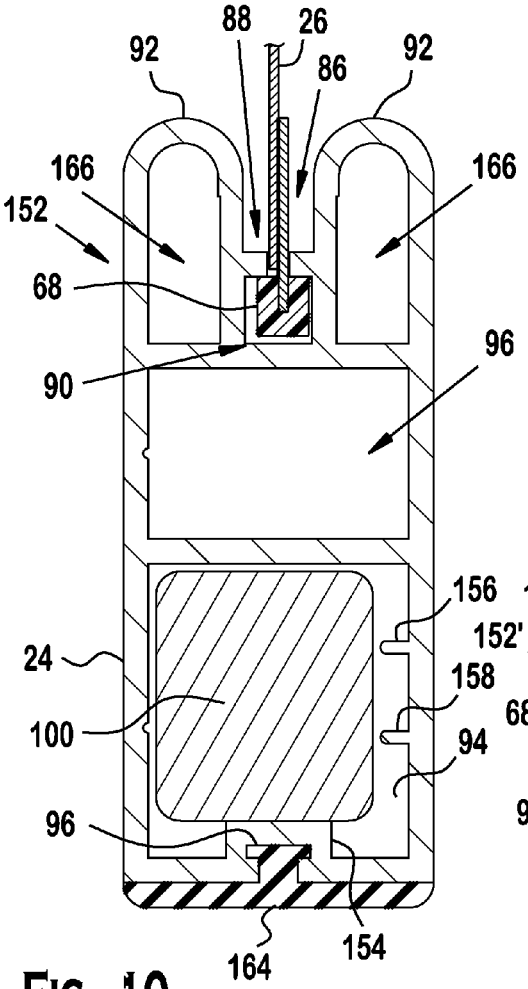
FIG. 10 is a cross-sectional view of the horizontal track of FIG. 1, taken perpendicular to its longitudinal axis.
Figure 15:
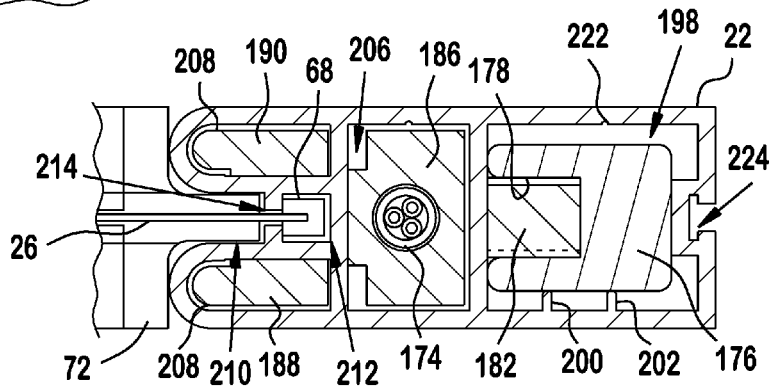
FIG. 15 is a cross-sectional view of the right side track along with a partial cross-sectional view of the horizontal track of FIG. 1.

Referring to FIGS. 10 and 15, the horizontal track 24, the left side track 20, and the right side track 22 may share a single cross-sectional profile 152. In FIG. 10, the track profile 152 is shown in use as a horizontal track 24. In this configuration, the primary accessory receiving channel 94 may accommodate a weight bar 100, which may be a ½ inch by ¾ inch steel bar. The weight bar 100 may be positioned within the primary receiving channel 94 by the end-cap stem blocking member 154, the upper rail guide 156, and the lower rail guide 158.

Figure 11:
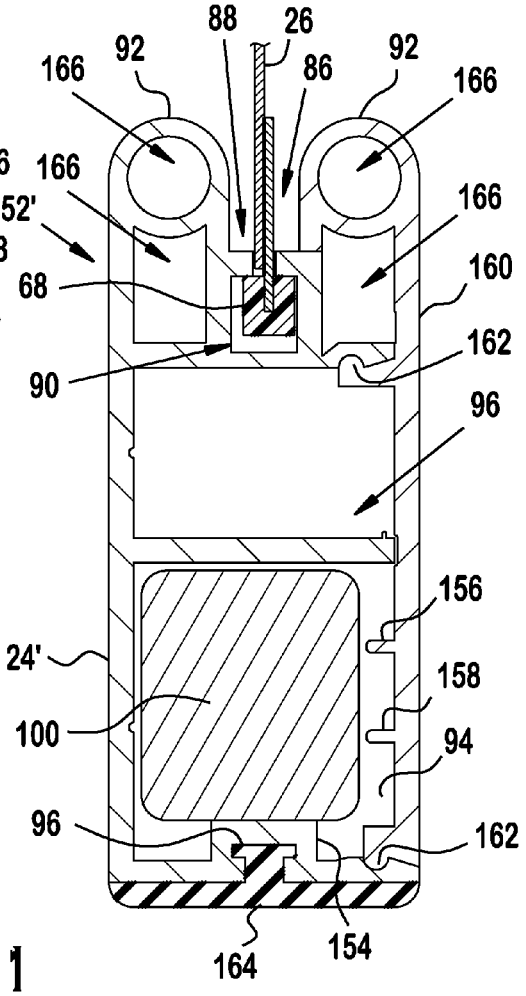
FIG. 11 is a cross-sectional view of another embodiment of the horizontal track of FIG. 1, taken perpendicular to its longitudinal axis.

In FIG. 11, the cross-sectional profile of the track 152' is substantially the same as in FIG. 10, but a front portion 160 of the track 24' is removable and forms a cover. The removable portion 160 may be secured to the track 24' with snap fittings 162. This feature allows weight bars 100 to be installed in the horizontal track 24' after the retractable wall structure 12 has been erected. This may improve constructability of the system and enhance the safety of workers because handling the horizontal track with preloaded weight bars 100 is significantly heavier than handling an empty horizontal track.

FIGS. 10 and 11 show an elastomeric cap 164 disposed in the tertiary accessory channel 96. Arcuate receiving channels 166, as well as the primary and secondary accessory receiving channels 94, 96 may receive sound damping materials to enhance the sound dampening effect of the retractable wall system.

Figure 12:
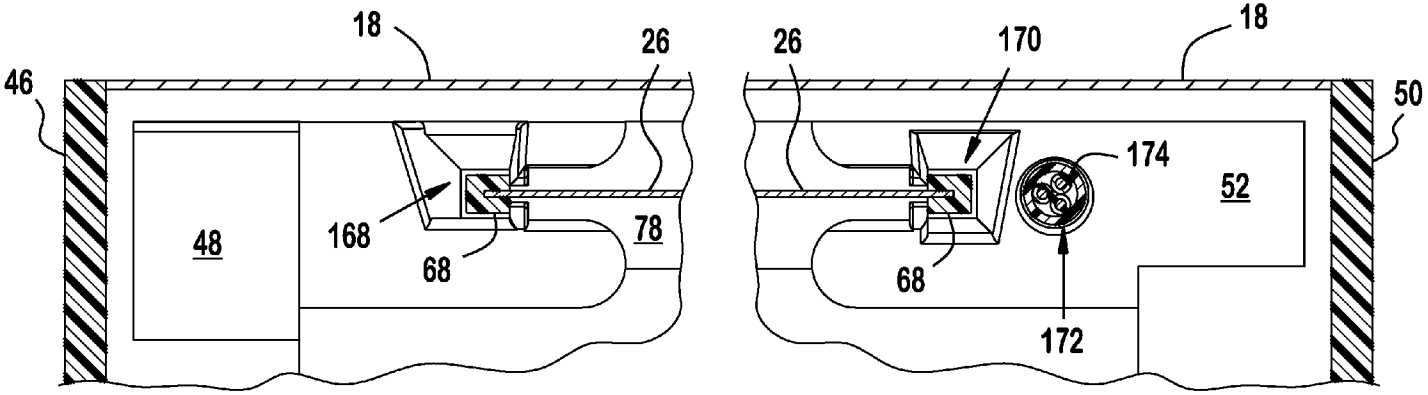
FIG. 12 is a partial sectional view of the head rail of FIG. 1, taken perpendicular to the vertical tracks and from below the tube and motor assembly.
Figure 13:
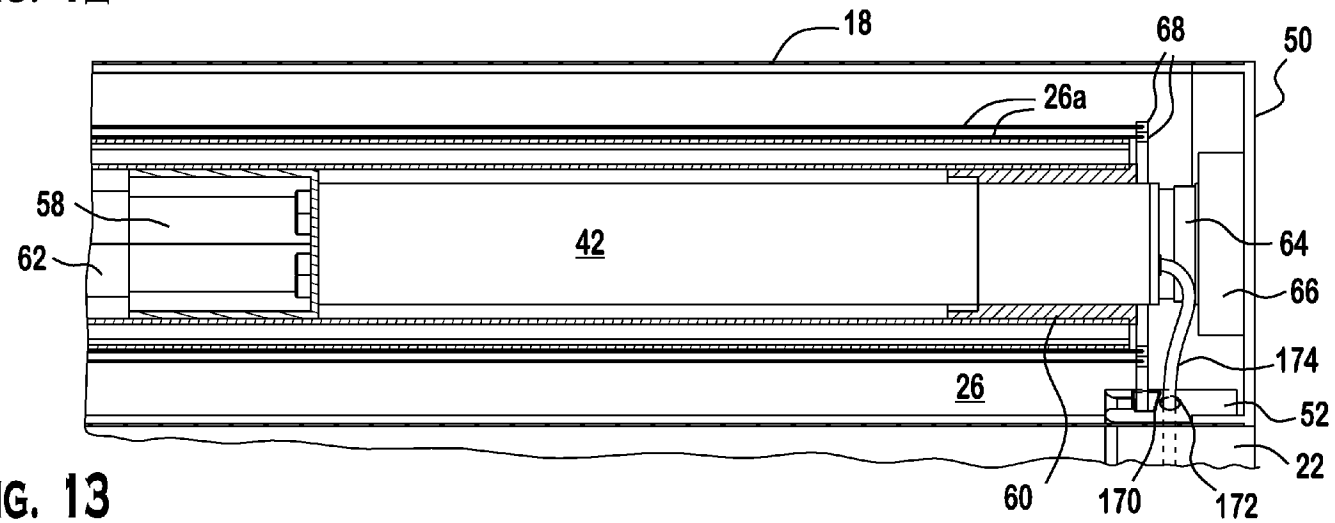
FIG. 13 is a partial sectional view of the head rail, tube and motor assembly of FIG. 1, taken parallel to the vertical tracks.

FIG. 12 shows the left feeder-clip 48 and its tapered guide hole 168. The tapered guide hole 168 receives the zippered edge 68 of the flexible barrier material 26 as it spools off the tube (not shown). Similarly, FIGS. 12 and 13 show the right feeder-clip 52 and its tapered guide hole 170, which receives the zippered edge 68 of the other side of the flexible barrier material 26. The right feeder clip 52 may further include a circular passage 172 for receiving a power cord 174 from the motor 42.

Figure 14:
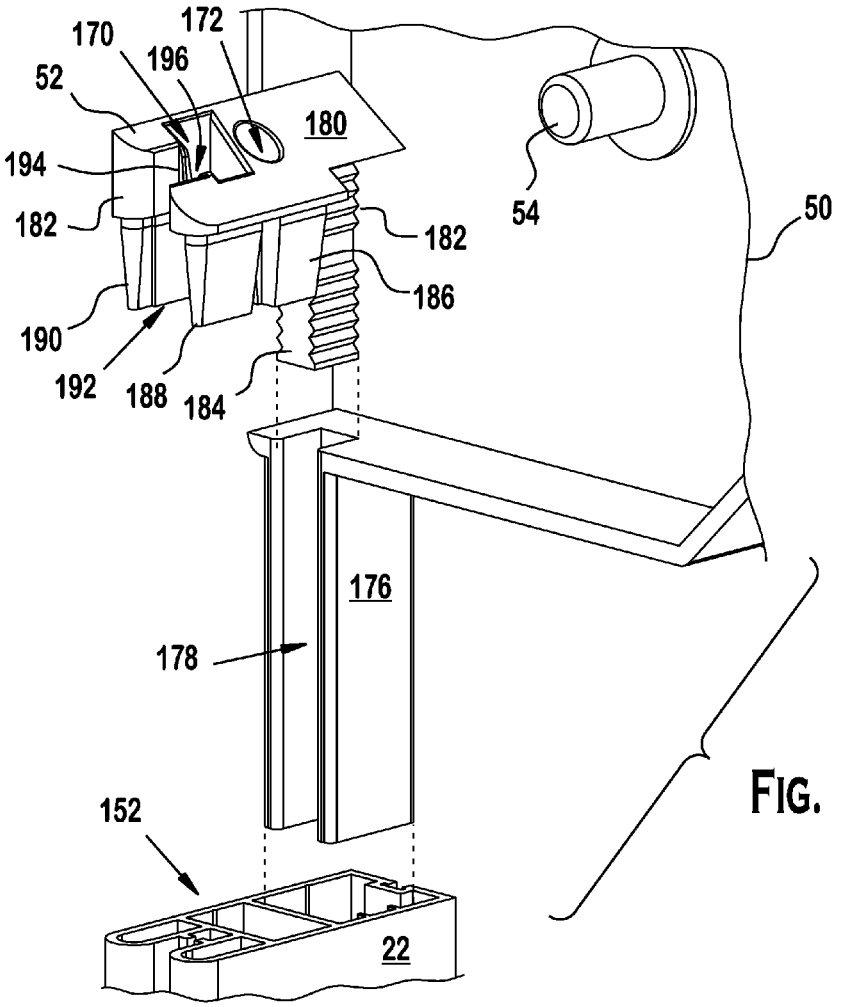
FIG. 14 is an exploded view of the right side end-cap assembly of the retractable wall system of FIG. 1.

Referring to FIG. 14, the right end-cap 50 may include a stem 176 having a rectangular channel 178. The right side feeder-clip 52 may include a beveled top surface 180, a central base portion 182, and four plugs 184, 186, 187, 188. One end of the feeder-clip 52 may include an elongated and corrugated plug 184. Next to the elongated and corrugated plug 184 and disposed in the middle of the feeder-clip 52 may be a second plug 186. The second plug 186 may be wider and shorter than the elongated corrugated plug 182. Also, a pair of contralateral plugs 188, 190 may be disposed on the other side of the second plug 186.

The right feeder-clip 52 may include a circular passage 172 that extends from the beveled top surface 180 through the second plug 186. The passage 172 may be configured and dimensioned to receive an electrical cable for the motor. Additionally, the beveled top surface 180 may include a first tapered rectangular passage 170 which extends through the feeder-clip 52. A second rectangular passage 192 may extend from the beveled top surface 180 through the feeder-clip 52 between the contralateral plugs 188, 190. The first rectangular passage 170 and the second rectangular passage 192 may be separated by a thin wall 194. The thin wall 194 may include a tapered slit 176 which extends from the top of the thin wall to the bottom of the thin wall.

As shown in FIG. 15 the right feeder-clip 52 may be inserted into the rectangular channel 178 of the end-cap 50. The stem 176 of the end-cap may be seated within the primary accessory channel 198 and may be positioned in the primary accessory channel 198 by the upper guide rail 200, the lower guide rail 202, and the end-cap stem blocking member 204. The second plug 186 of the feeder-clip 52 may be received in the secondary accessory receiving channel 206. The secondary accessory receiving channel 206 may be used to accommodate an electrical cable 174 that extends from the motor 42 to an electrical outlet outside the track. The pair of contralateral plugs 188, 190 may be disposed in the opposing arcuate cavities 208 at the front of the track. The traveling guide member 72 may be disposed in the rectangular receiving channel 210 of the track and the zippered end 68 of the flexible membrane barrier 26 may be disposed in the internal anchoring cavity 212. The material connecting the zipper 68 and the flexible membrane barrier 26 may be disposed in the slot 214 between the rectangular receiving channel 210 and the internal anchoring cavity 212.

Figure 16:
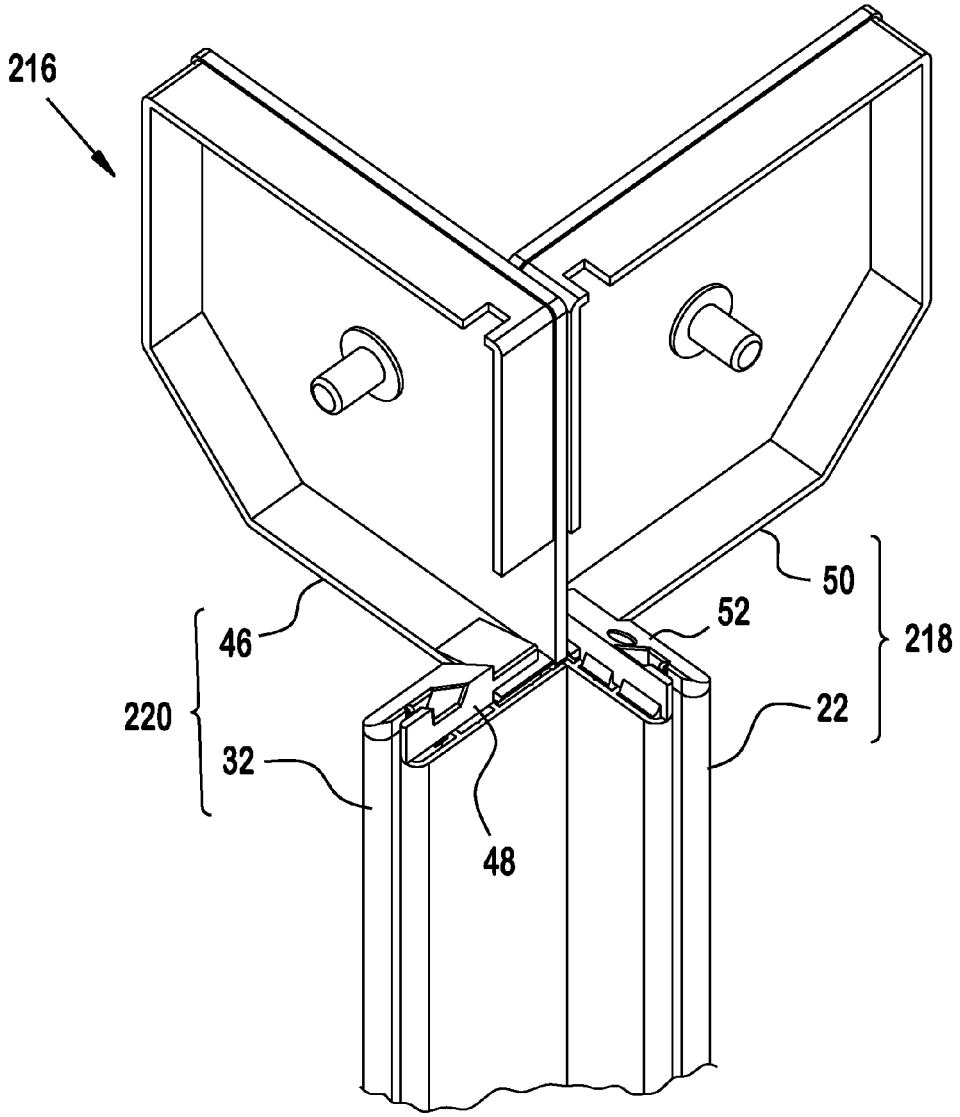
FIG. 16 is a perspective view of a pair of adjacent tracks and end caps from abutting retractable wall systems of FIG. 1.

FIG. 16 shows an exemplary corner assembly 216 formed from a first end-cap and track 218 and a second end-cap and track 220. The first end-cap and track 218 and the second end-cap and track 220 may be disposed at an approximately 90 degree angle. The corner assembly 216 may be used to construct adjacent retractable wall systems, as shown in FIG. 1.

Figure 17A:
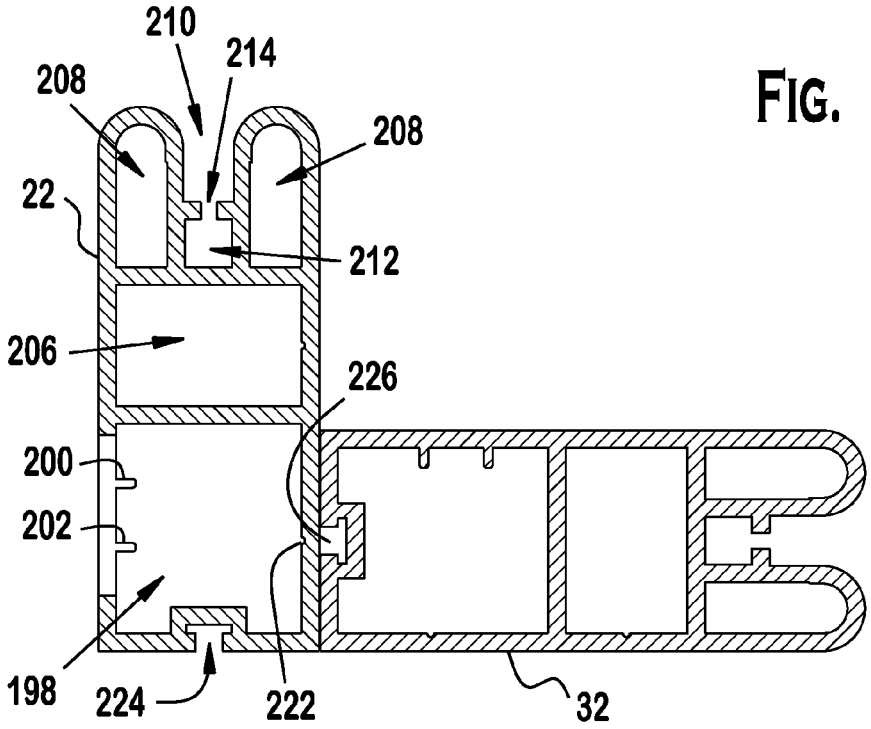
FIG. 17*a* is a view of the tracks of FIG. 17 fastened together to form a corner assembly.
Figure 17:
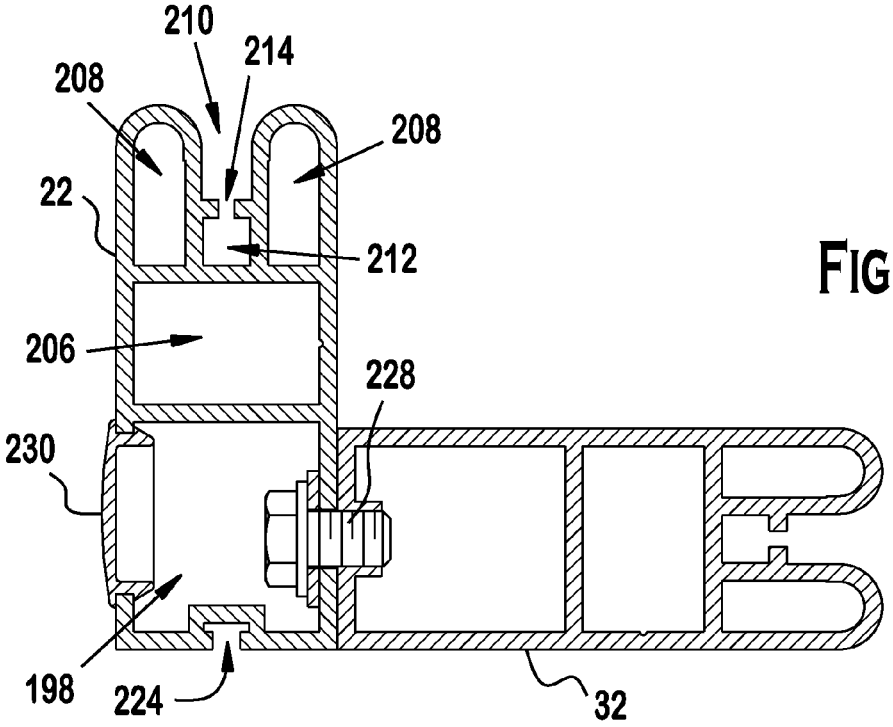
FIG. 17 is a detailed view of a pair of tracks aligned to form a corner assembly.

FIG. 17 shows an exemplary alignment of two tracks 22, 20 which may be used to construct a corner assembly 216. In the track alignment, the alignment groove 222 in the primary accessory receiving channel 198 may be disposed opposite the tertiary accessory groove 226 of the adjacent track. FIG. 17*a* shows how the two tracks 20, 32 may be securely fastened to each other. In a preferred method, a guide hole may be drilled between the upper and lower guide rails 200, 202 in the primary accessory receiving channel 198. The guide hole may be enlarged to an entry hole in order to provide access to the interior of the primary accessory receiving channel. A fastener 228 may be positioned in the alignment groove 222 (FIG. 17) and advanced into the tertiary accessory groove 226 (FIG. 17) of the adjacent track. The enlarged hole may be covered with a plastic cap 230.

Figure 18:
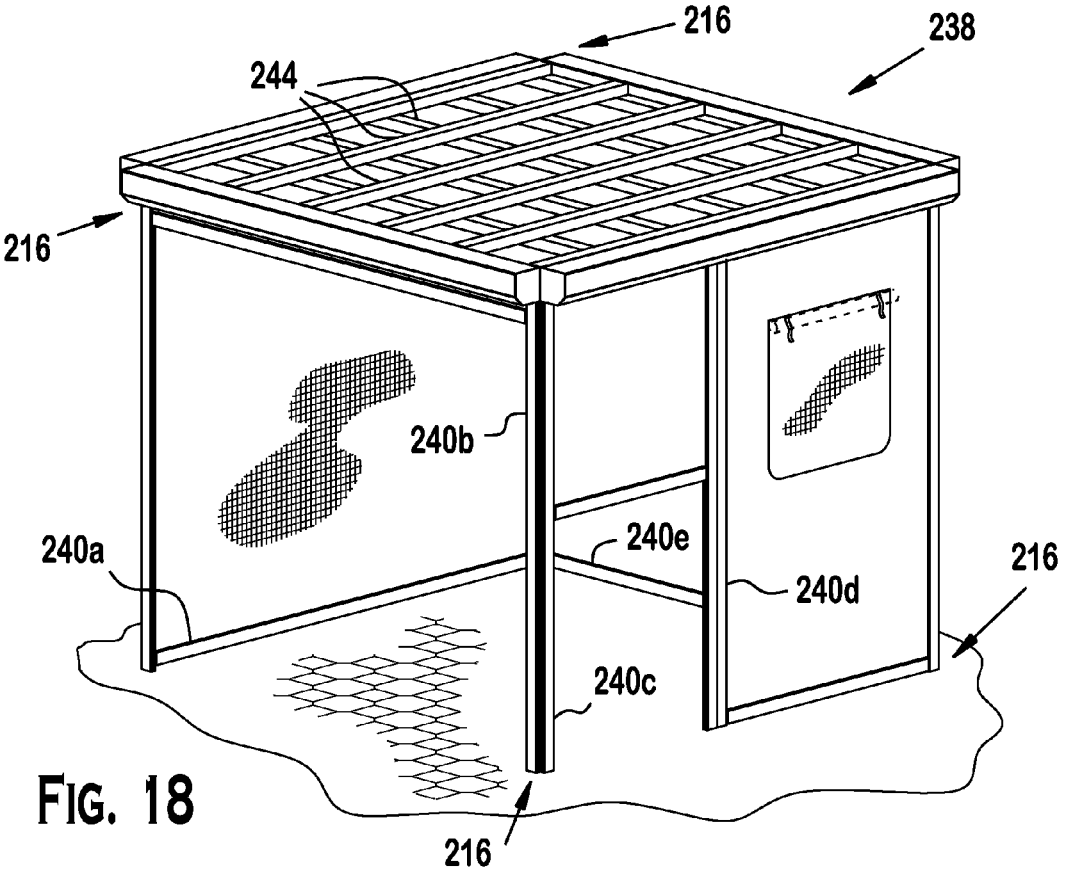
FIG. 18 is a perspective view of a free standing retracting wall system structure.

Referring to FIG. 18, four corner assemblies 216 may be used to construct a free standing structure. The free standing structure may be formed from four (or more) retractable wall systems 240*a*, 240*b*, 240*c*, 240*d*, 240*e*. Two retractable wall systems 240*c*, 240*d* may be joined together to form one side of the structure. One of the retractable wall systems 240*c* may be used as a door for the structure.

Figure 19:
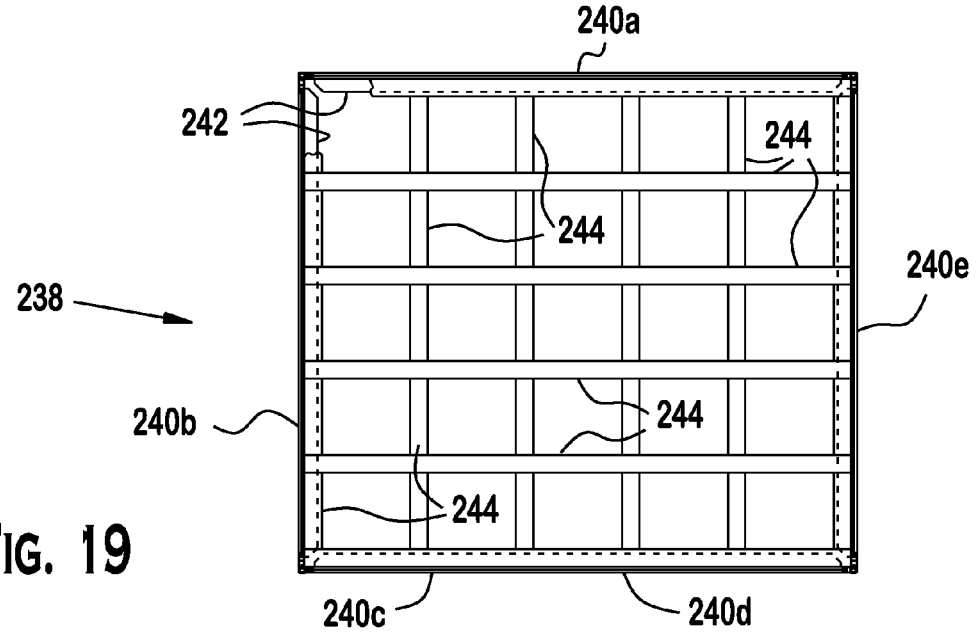
FIG. 19 is a plan view of the free standing structure of FIG. 18.

Referring to FIG. 19, a short ledge 242 may extend from the lower portion of the head rail into the enclosed space. The short ledges 242 of opposing retractable wall systems 240*b*, 240 *e* may be used to support beams 244, which may form a cover for the structure 238. The beams may be used to form a continuous cover or a lattice cover. For example, wood boards (e.g., 1"×2" or 2"×4" boards) may be supported by the head rail ledges to form a lattice cover, which may allow the structure to be used as a temporary booth (or Sukkah) that is constructed for use during the Jewish festival of Sukkot.

Figure 20:
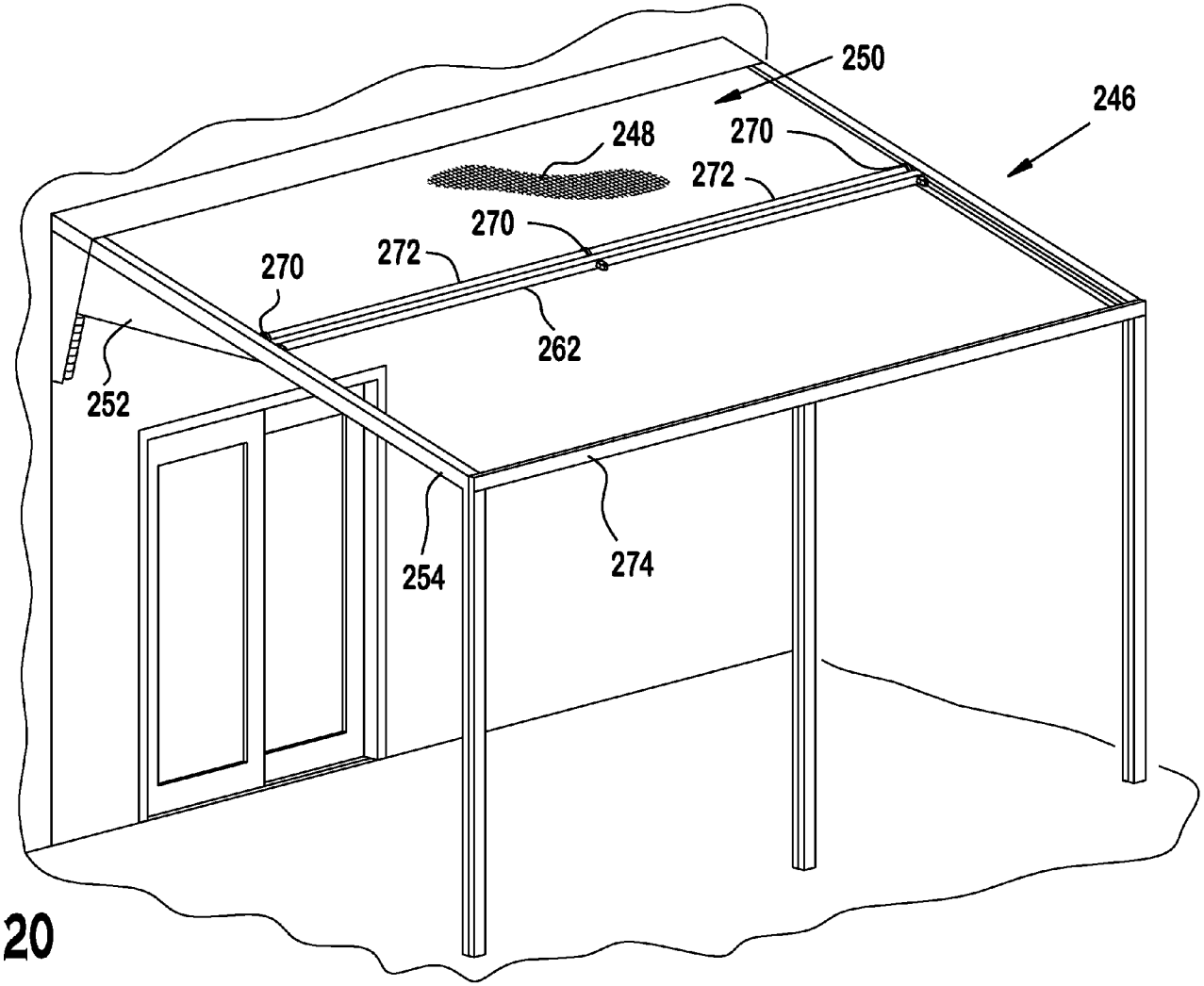
FIG. 20 is a perspective view of an exemplary retractable awning system.

Referring to FIG. 20, the retractable wall system may be adapted for use as an awning 246. A webbing material may 248 be molded to the flexible membrane barrier 250 that forms the awning cover in order to make the canopy stronger while maintaining light weight. The awning 246 may include a side pennant 252. As shown, in FIG. 21, the side track of the retractable wall system may be modified such that the side frame 254 incorporates a reinforced flexible membrane barrier connection 256 to provide a taunt but retractable ceiling canopy. The side frame 254 may include a roller track 258 for a wheel 260 which is connected to the front crossbar 262. Also, the side frame 254 may include a gutter 264 for collecting and transporting rain water 266. An exterior groove 268 on the side frame may be used to house a sealant for sealing the frame to a structure or an abutting awning frame.

Figure 21:
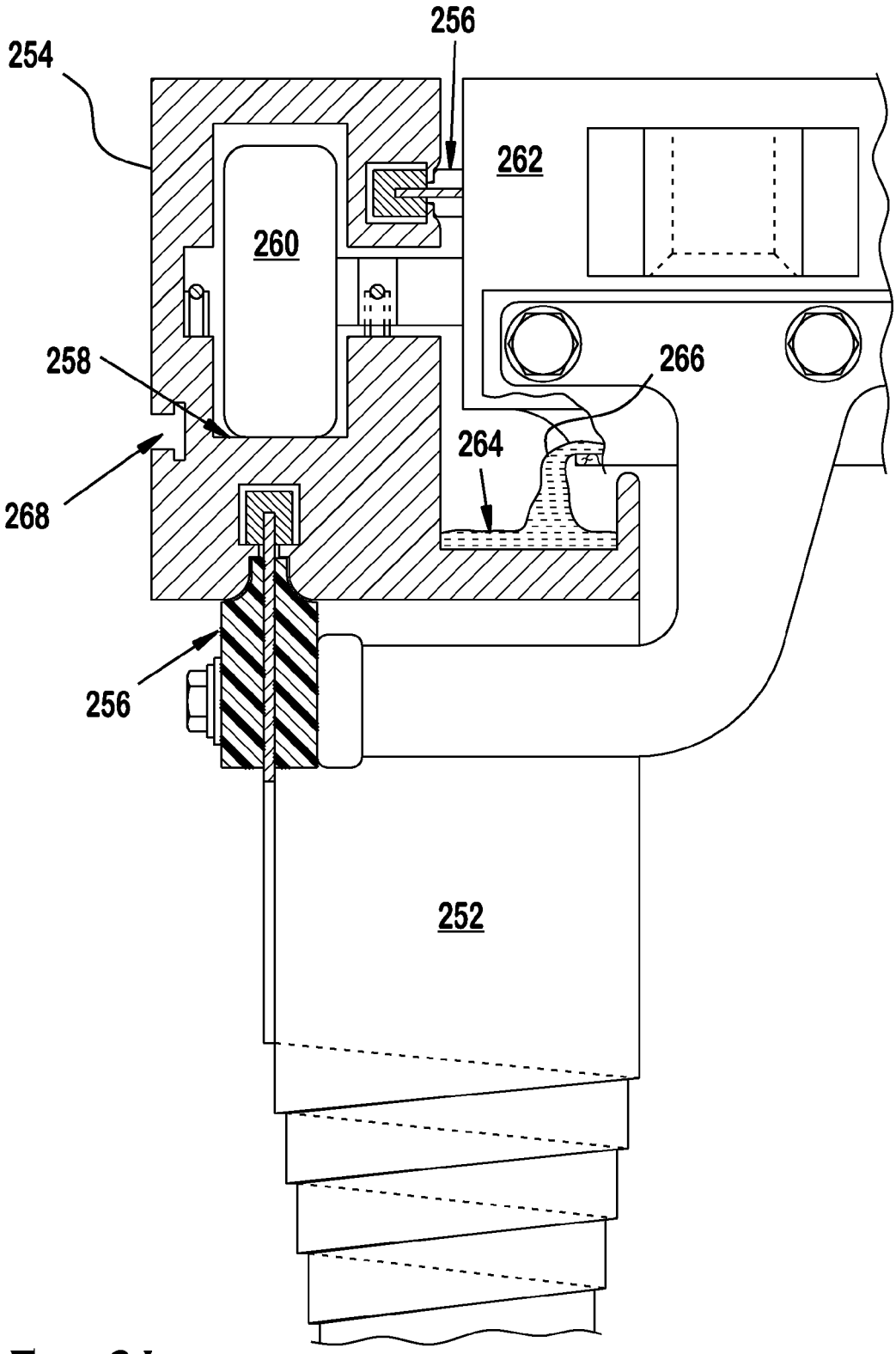
FIG. 21 is a sectional view of the left track of the retractable awning system of FIG. 20.

As depicted in FIGS. 21-23, a reinforced flexible membrane barrier connection 256 may be used to deploy a side pennant 252 with the ceiling canopy. Referring to FIG. 23, the front cross bar 262 may support a bracket 270 that holds a loop of canopy material 272 to form a pocket to collect and direct rain water 266 to the gutter 264. The front partition 274 of the awning structure 246 may include a channel 276 for receiving water from the gutter. In another embodiment, the gutter and wheel track may the same structure. The front partition 274 further may include a solenoid 278 that may be used to lock the awning in the deployed configuration. Additionally, a brake (not shown) may be available on the motor end and the non-motor end of the awning spool. The retractable wall system may be constructed from materials selected to better withstand changes in temperature, corrosion, or degradation from ultraviolet light.

While it has been illustrated and described what at present are considered to be preferred embodiments of the present invention, it will be understood by those skilled in the art that various changes and modifications may be made, and equivalents may be substituted for elements thereof without departing from the true scope of the invention. Additionally, features and/or elements from any embodiment may be used singly or in combination with other embodiments. Therefore, it is intended that this invention not be limited to the particular embodiments disclosed herein, but that the invention include all embodiments falling within the scope and the spirit of the present invention.

What is claimed is:

1. A track for a retractable wall system comprising:

an elongated member having a first cross-sectional profile which comprises a front wall, a rear wall spaced from the front wall, a bottom wall connecting the front wall and the rear wall, a first top wall adjacent the front wall, a second top wall adjacent the rear wall, and an open channel disposed between the first top wall and the second top wall which comprises a first side wall adjoining the first top wall, a second side wall connected to the second top wall, a first ledge extending from the first side wall into the open channel, and a second ledge extending from the second side wall into the open channel, the first and second ledges defining a slot between the first side wall and the second side wall, a lateral wall that extends from the front wall to the rear wall, and a conduit disposed between the front wall and the rear wall which is connected to the open channel via the slot, the conduit being formed by the first ledge, the second ledge, the first side wall, the second side wall, and the lateral wall.

2. The track of claim 1, wherein the lateral wall is connected to the first side wall.

3. The track of claim 2, wherein the lateral wall is connected to the second side wall.

4. The track of claim 3, wherein the first cross-sectional profile further comprises an interior wall that extends from the front wall to the rear wall.

5. The track of claim 4, wherein the front wall, lateral wall, rear wall and interior wall define a first interior channel.

6. The track of claim 5, wherein the front wall, interior wall, rear wall and bottom wall define a second interior channel.

7. The track of claim 6, wherein the front wall, the first top wall, the first side wall and the lateral wall define a third interior channel.

8. The track of claim 7, wherein the rear wall, the second top wall, the second side wall and the lateral wall define a fourth interior channel.

9. The track of claim 8, wherein the bottom wall comprises another open channel.

10. The track of claim 6, wherein the second interior channel comprises a rail guide that is configured to position a weight bar in the second interior channel.

11. The track of claim 6, further comprising a weight bar disposed in the second interior channel.

12. The track of claim 1, wherein the first top wall is curved.

13. A retractable wall system comprising:

a tube having a longitudinal axis;

a first track perpendicular to the longitudinal axis;

a second track opposite the first track;

a track of claim 1 disposed between the first track and the second track;

a flexible membrane barrier that is connected to the tube and which comprises a first side which is disposed in the first track, a second side which is disposed in the second track, and a third side which is secured within the conduit of the track of claim 1.

14. The retractable wall system of claim 13, wherein the flexible membrane barrier comprises a material selected from the group consisting of cotton, leather, rayon, and polyester.

15. The retractable wall system of claim 13, wherein the flexible membrane barrier comprises a vinyl fabric.

16. The retractable wall system of claim 15, wherein the vinyl fabric is capable of receiving a print design.

17. The retractable wall system of claim 13, wherein the flexible membrane barrier comprises a mass loaded vinyl acoustic barrier.

18. The retractable wall system of claim 17, wherein the mass loaded vinyl acoustic barrier has a sound transmission class rating substantially equal to or greater than 26.

19. The retractable wall system of claim 13, wherein the third side of the flexible membrane barrier comprises a zipper edge, and the zipper edge is received in the conduit.

20. The track of claim 9, further comprising one of an elastomeric end cap, flexible seal, or brush, and the other open channel in the bottom wall connects with the elastomeric end cap, flexible seal, or brush.

* * * * *